US011833647B2

(12) United States Patent
Shepard et al.

(10) Patent No.: US 11,833,647 B2
(45) **Date of Patent: *Dec. 5, 2023**

(54) BUSHING HANDLE

(71) Applicant: CARR LANE MANUFACTURING CO., St. Louis, MO (US)

(72) Inventors: Nancy Jerrell Ruth Shepard, St. Peters, MO (US); Joshua Matthew Herschbach, Highland, IL (US); Colin Walker Frost, St. Louis, MO (US)

(73) Assignee: Carr Lane Manufacturing Co., St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/590,298

(22) Filed: Feb. 1, 2022

(65) Prior Publication Data

US 2022/0152802 A1 May 19, 2022

Related U.S. Application Data

(63) Continuation of application No. 16/686,422, filed on Nov. 18, 2019, now Pat. No. 11,235,450.

(51) Int. Cl.
*B25B 27/00* (2006.01)
*B25B 27/28* (2006.01)

(52) U.S. Cl.
CPC ..... *B25B 27/28* (2013.01)

(58) Field of Classification Search
CPC ..... B25B 27/00; B25B 27/0092; B25B 27/28; B23P 11/00
See application file for complete search history.

(56) References Cited

U.S. PATENT DOCUMENTS 2,769,360 A 11/1956 Cottrell et al.
4,819,521 A * 4/1989 Lang ..... B25B 13/463 81/177.1
5,199,332 A * 4/1993 Batten ..... B25B 23/0057 81/124.1
6,098,503 A * 8/2000 Hlinka ..... B25B 13/04 81/124.3
11,235,450 B2 * 2/2022 Shepard ..... B25B 27/28
2010/0314129 A1 12/2010 Fern
(Continued)

OTHER PUBLICATIONS

Bonde Products website, http://www.bondeproducts.com:80/index_files/sp.htm, archived Mar. 13, 2019 (2 pages).
(Continued)

*Primary Examiner* — Lee D Wilson
(74) *Attorney, Agent, or Firm* — Lewis Rice LLC

(57) ABSTRACT

A bushing handle for use with a renewable bushing. The bushing handle facilitates a quick-change configuration by using a liner bushing disposed in a through bore. The liner bushing can accept a plurality of different renewable bushings having various inner diameters and other characteristics, eliminating the need to stock and store a multitude of different bushing handles. The liner bushing may be a lock liner, which facilitates the quick-change function, and provides a ground inner diameter, which is more resistant to wear and tear than the light metal construction of the handle itself.

20 Claims, 2 Drawing Sheets

(56) References Cited

U.S. PATENT DOCUMENTS

| | | | | |
|---|---|---|---|---|
| 2021/0146516 | A1* | 5/2021 | Shepard | B25B 27/28 |
| 2022/0152802 | A1* | 5/2022 | Shepard | B25B 27/28 |

OTHER PUBLICATIONS

Catalog re "Precision Drill Jig Bushings," Carr Lane Manufacturing Co., www.carrlane.com, 2008 (74 pages).
Internet printout re "Handle Bushing," Boneham Metal Products, Inc., http://www.bonehamusa.com, 2019 (3 pages).
Internet printout re "Drill Bushing Types," Drill Bushings Warehouse, www.drill-bushings.com, printed on Sep. 29, 2019 (3 pages).
Internet printout re "Permanent Bushing Handles, Drill-Jig Bushings" Carr Lane Manufacturing Co., printed on Sep. 29, 2019 (1 page).
"Un-A-Lok Liner Bushings," Carr Lane Manufacturing Co., p. 564 of catalog, www.carrlane.com, dated Aug. 2019 (1 page).

* cited by examiner

BUSHING HANDLE

CROSS-REFERENCE TO RELATED APPLICATIONS

This application is a continuation of U.S. Utility patent application Ser. No. 16/686,422, filed Nov. 18, 2019, the entire disclosure of which is incorporated herein by reference.

BACKGROUND OF THE INVENTION

Field of the Invention

This disclosure is related to the field of metalworking, and more particularly, to a reusable multi-bushing handle assembly.

Description of the Related Art

Precision is crucial in many manufacturing enterprises, and bushings are commonly used to guide drills and other machining tools to control cuts. In drilling applications, for example, a bushing may be used to control hole location and depth. Bushing handles are a type of portable bushing that can provide accuracy without the need for a rigid fixture.

Prior art bushing handles generally have a bushing permanently seated in the handle. This means that, for each bushing size or configuration, a different bushing handle is needed, even though the handle portion is essentially the same in each. This defeats a purpose of using a handle bushing, which is to have a small, portable bushing for ease of use on a job site because the user is forced to stock, maintain, and transport a large number of devices.

To address this, a lock screw is sometimes used to affix a removable bushing to the handle, but this creates other problems. For example, a lock screw configuration uses a through bore in the aluminum handle itself, and the bushing shoulder is clamped to the rim by an adjacent lock screw. However, this can introduce wear and misalignment over time because the soft aluminum inner diameter is worn down over time.

SUMMARY OF THE INVENTION

The following is a summary of the invention in order to provide a basic understanding of some aspects of the invention. This summary is not intended to identify key or critical elements of the invention or to delineate the scope of the invention. The sole purpose of this section is to present some concepts of the invention in a simplified form as a prelude to the more detailed description that is presented later.

Because of these and other problems in the art, described herein, among other things, is a bushing handle comprising: a handle portion in the configuration of a rectangular prism having a rounded distal end; a head portion opposing the handle portion and generally in the configuration of a rectangular prism having a rounded distal end, the head portion having a top surface and an opposing bottom surface; a through bore disposed through the head portion from the top surface to the bottom surface, an axis of the through bore being generally perpendicular to a major plane of the head portion, and the through bore sized and shaped to accept a liner bushing; and a liner bushing permanently disposed in the through bore, an axis of the liner bushing being coaxial with the axis of the through bore, and the liner bushing having a lock lip configured to accept a shoulder of a renewal bushing.

In an embodiment, the bushing handle further comprises an angled portion disposed between the head portion and the grip portion.

In a further embodiment, the angled portion is attached to the head portion at an angle effective to cause, when the bottom surface of the head portion is disposed generally coplanar with a work surface, the angled portion to be disposed at about a 45° angle to the work surface.

In a further embodiment, the handle portion is attached to the angled portion at an angle effective to cause, when the bottom surface of the head portion is disposed generally coplanar with the work surface, the handle portion to be disposed at about a 15° angle to the work surface.

In a further embodiment, the grip portion comprises a through bore disposed at a distal end thereof.

In a further embodiment, the through bore has a diameter smaller than the diameter of the head portion through bore.

In a further embodiment, the through bore is sized and shaped to hang the bushing handle.

Also described herein, among other things, is a method of performing a drilling operation comprising: providing a bushing handle comprising a grip portion and an opposing head portion having a through bore therein and a liner bushing coaxially seated in the through bore; providing a plurality of renewable bushings adapted to be coaxially seated in the liner bushing, each of the renewable bushings having a central bore and at least one shoulder; selecting a first renewable bushing from the plurality of renewable bushings; seating the first bushing coaxially in the liner bushing; locking the seated first bushing in the liner bushing at a first shoulder of the at least one shoulders by twisting the seated first bushing to place the first shoulder beneath between the lock lip; using the handle portion, disposing the seated first bushing in a work surface; and performing a drilling operation through the central bore of the selected first bushing when the seated first bushing is disposed in the work surface.

DESCRIPTION OF THE PREFERRED EMBODIMENT(S)

The following detailed description and disclosure illustrates by way of example and not by way of limitation. This description will clearly enable one skilled in the art to make and use the disclosed systems and methods, and describes several embodiments, adaptations, variations, alternatives and uses of the disclosed systems and methods. As various changes could be made in the above constructions without departing from the scope of the disclosures, it is intended that all matter contained in the description or shown in the accompanying drawings shall be interpreted as illustrative and not in a limiting sense.

Described herein, among other things, is a bushing handle for use with a renewable bushing, which facilitates a quick-change configuration and includes a ground inner diameter.

Figure 1:
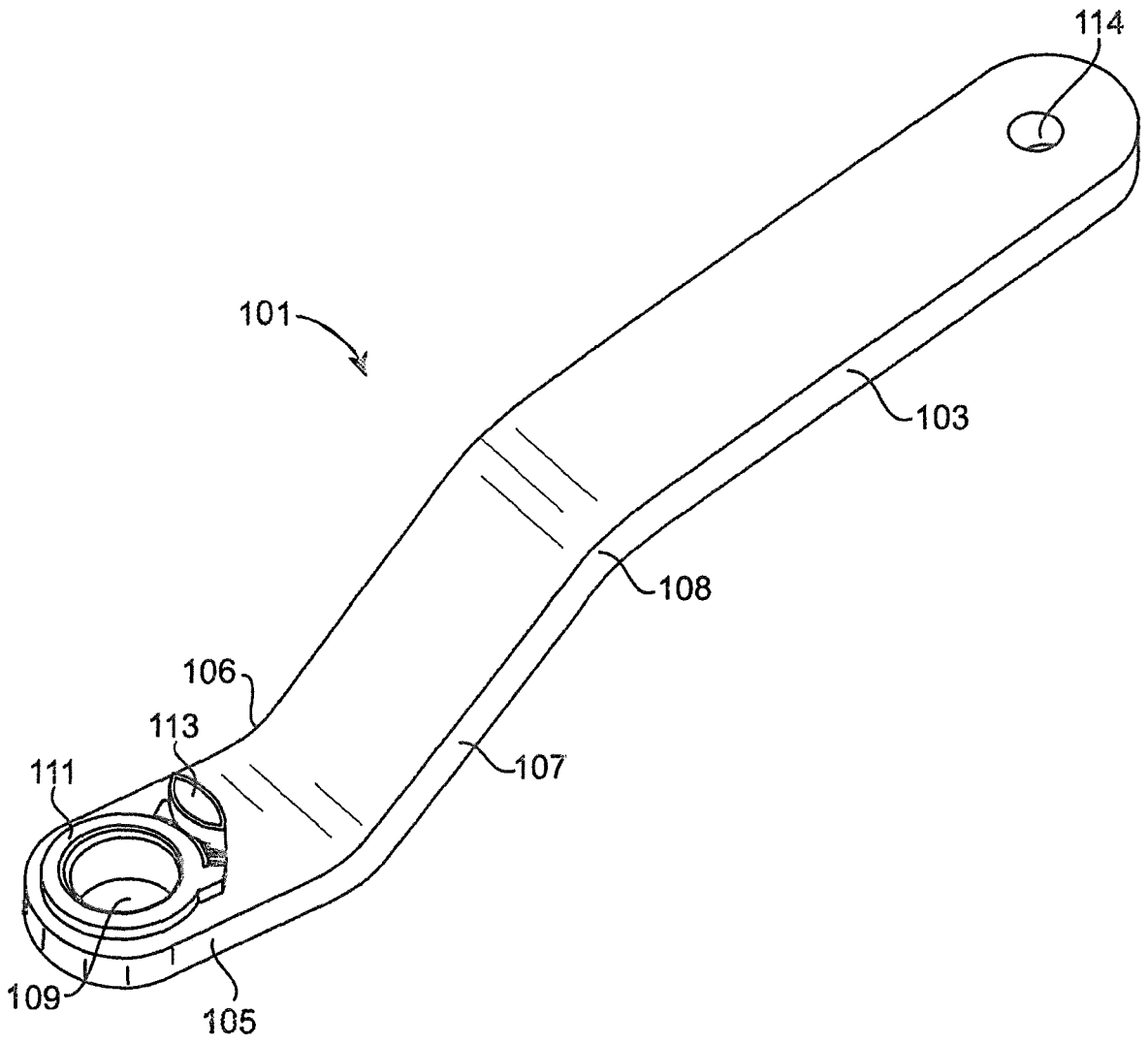
FIG. 1 depicts an isometric perspective view of an embodiment of a bushing handle according to the present disclosure.

As can be seen in the depicted embodiment of FIG. 1, a bushing handle (101) may comprise a handle portion (103) disposed at one end thereof and a head portion (105) opposite the handle portion (103). The depicted bushing handle (101) is in the overall configuration of an elongated rectangular prism having rounded distal ends at the handle portion (103) and head portion (105) and in an embodiment may be sized and shaped for ergonomic use by the hand of a human user.

Figure 2:
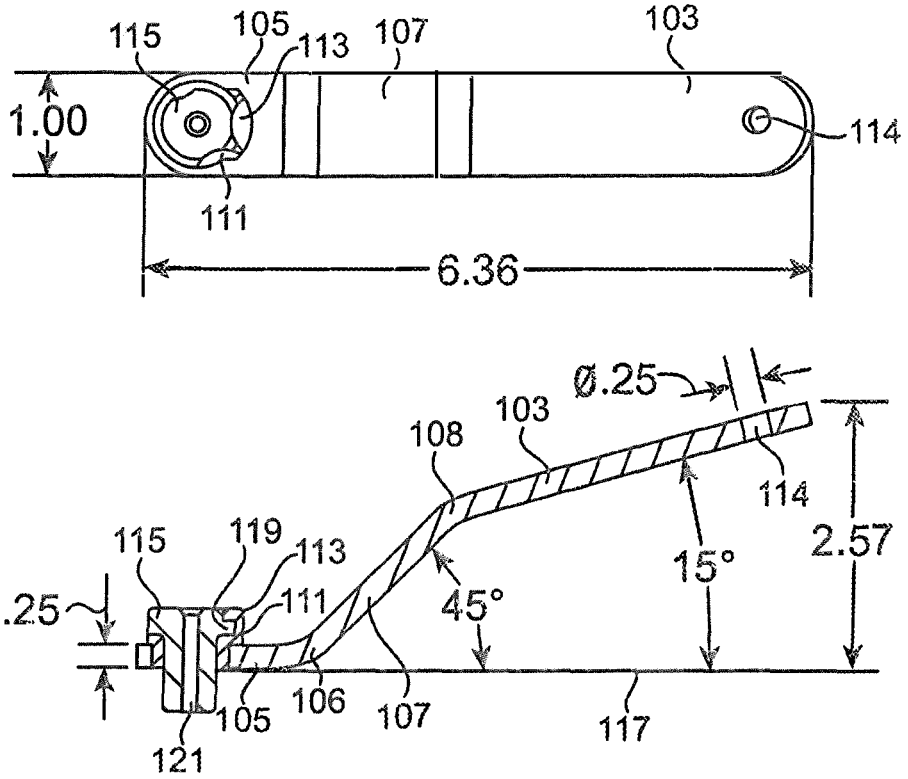
FIG. 2 depicts a side elevation view of a bushing handle according to the present disclosure in use with a renewable bushing.

In the depicted embodiment, the bushing handle (101) includes two bends (106) and (108) which define an angled portion (107). As can be seen in FIG. 2, a purpose of the angled portion (107) is to elevate the handle portion (103) off a work surface (117) for ease of use. In the depicted embodiment of FIG. 2, a first bend (106) proximate the head portion (105) has an angle effective to cause the angled portion (107) to be at about a 45° angle from the work surface (117) when the head portion (105) is disposed such that a bottom surface of the head portion (105) is generally coplanar with the top of the work surface (117).

Also depicted in the embodiment of FIG. 2, a second bend (108) has an angle effective to cause the handle portion (103) to be at about a 15° angle from the work surface (117) when the bottom surface of the head portion (105) is generally coplanar to the top of the work surface (117). This is an ergonomic consideration to enable the user to grip the handle portion (103) in a comfortable and stable manner during use. In other embodiments, different angles for the bends (106) and (108) may be used. Additionally and/or alternatively, an embodiment may have only one bend, or may have more than two bends, or one or more angles may vary.

As can be seen in the depicted embodiment of FIG. 1, the handle end (103) may include a through bore (113) disposed proximate the distal end. The depicted through bore (113) has a relatively small diameter and may be used to organize the bushing handle (101), such as by hanging it on a hook or nail, or by including it on a ring. In an embodiment, a different means for organizing or storing the bushing handle (101) may be included, in addition to or alternatively to the depicted through bore (113). In an alternative embodiment, the bushing handle (101) may not include a storage or organizing means.

Also, as shown in the embodiment of FIG. 1, the depicted head portion (105) includes a through bore (109). The depicted through bore is disposed proximate to a distal end of the head portion (105), and has a radial center generally coaxial with the radial center of the rounded end of the head portion (105). However, in an alternative embodiment, the through bore (109) may be disposed in a different location in the head portion (105), and/or may not be coaxial with the rounded end. Further, in an embodiment, the ends of the bushing handle (101) may not be rounded at all, but rather may be a different shape, such as a polygonal shape, an oval shape, or other curve. The depicted through bore (109) is sized and shaped to accept a corresponding lock liner (111). Generally, the lock liner (111) is a separately manufactured component that is permanently disposed in the bushing handle (101). Although removal of the lock liner (111) is theoretically possible, there is typically no reason or need to do so, and the connection should be tight enough to inhibit or prevent unintended dislodging of the lock liner (111) from the through bore (109).

In the depicted embodiment, the lock liner (111) is preferably made of a durable metal which can accept a renewable bushing (115). The depicted lock liner (111) is made from steel or steel alloy and has a ground inner diameter which can tolerate repeated use of a renewable bushing (115) over a long period of time without significant degradation in performance. The depicted lock liner (111) includes an overhanging lock lip (113) which can be used to capture the shoulder of a bushing (115) and thereby hold it in place. The depicted lock liner (111) is in the nature of a Un-A-Lok™ liner bushing, which provides wear resistance and enables quick bushing changes.

FIG. 2 depicts an embodiment of a handle bushing (101) as described herein in use with a renewable bushing (115). As can be seen in FIG. 2, the renewable bushing (115) is disposed within the lock liner (111) and twisted so that the shoulder (119) is captured beneath the lock lip (113) of the liner bushing (115). The renewable bushing (115) can then be seated in the work surface (117) at the desired location, and held by the user via the handle portion (103) to maintain control. A drill bit then passes through a central bore (121) of the renewable bushing (115) to conduct the desired work operation to be performed. When the operation is complete, the renewable bushing (115) can be removed by the user pulling the bushing handle (101) away from the work surface (117), and the renewable bushing (115) can be rotated so that the shoulder (119) is no longer captured by the lock lip (113), and the renewable bushing (115) can then be removed from the lock liner (111).

As will be clear to a person of ordinary skill in the art, this configuration enables the use of a plurality of renewable bushings (115) having different inner diameters, or other varying characteristics, with a singular bushing handle (101). The lock liner (111) provides a ground inner diameter to accept the bushing, and is more resistant to wear and degradation than the bushing handle (101) itself.

Although a Un-A-Lok™ liner (111) is depicted in the figures, other lock liners or liner bushings may be used in an embodiment. Additionally, the invention is not necessarily limited to the specific shape or configuration of bushing handle depicted in the figures.

While the invention has been disclosed in conjunction with a description of certain embodiments, including those that are currently believed to be the preferred embodiments, the detailed description is intended to be illustrative and should not be understood to limit the scope of the present disclosure. As would be understood by one of ordinary skill in the art, embodiments other than those described in detail herein are encompassed by the present invention. Modifications and variations of the described embodiments may be made without departing from the spirit and scope of the invention.

The invention claimed is:

1. A bushing handle comprising:

a grip portion generally in the configuration of a rectangular prism;

a head portion opposing said grip portion and generally in the configuration of a rectangular prism, said head portion having a top surface and an opposing bottom surface;

a through bore disposed through said head portion from said top surface to said bottom surface, an axis of said through bore being generally perpendicular to a major plane of said head portion, and said through bore sized and shaped to accept a liner bushing; and a liner bushing permanently disposed in said through bore, an axis of said liner bushing being coaxial with said axis of said through bore, and said liner bushing having a lock lip configured to accept a shoulder of a renewable bushing.

2. The bushing handle of claim 1, further comprising an angled portion disposed between said head portion and said grip portion.

3. The bushing handle of claim 2, wherein said angled portion is attached to said head portion at an angle effective to cause, when said bottom surface of said head portion is disposed generally coplanar with a work surface, said angled portion to be disposed at about a 45° angle to said work surface.

4. The bushing handle of claim 3, wherein said grip portion is attached to said angled portion at an angle effective to cause, when said bottom surface of said head portion is disposed generally coplanar with said work surface, said grip portion to be disposed at about a 15° angle to said work surface.

5. The bushing handle of claim 1, wherein said grip portion comprises a through bore disposed at a distal end thereof.

6. The bushing handle of claim 5, wherein said through bore has a diameter smaller than the diameter of said head portion through bore.

7. The bushing handle of claim 6, wherein said through bore is sized and shaped to hang said bushing handle.

8. A bushing handle system comprising:

a handle comprising:

a grip portion generally in the configuration of a rectangular prism;

a head portion opposing said grip portion and generally in the configuration of a rectangular prism, said head portion having a top surface and an opposing bottom surface;

a through bore disposed through said head portion from said top surface to said bottom surface, an axis of said through bore being generally perpendicular to a major plane of said head portion, and said through bore sized and shaped to accept a liner bushing; and a liner bushing permanently disposed in said through bore, an axis of said liner bushing being coaxial with said axis of said through bore, and said liner bushing having a lock lip configured to accept a shoulder of a renewable bushing; and a plurality of renewable bushings adapted to be coaxially seated in said liner bushing, each of said renewable bushings having a central bore and at least one shoulder.

9. The bushing handle system of claim 8, wherein said handle further comprises an angled portion disposed between said head portion and said grip portion.

10. The bushing handle system of claim 9, wherein said angled portion is attached to said head portion at an angle effective to cause, when said bottom surface of said head portion is disposed generally coplanar with a work surface, said angled portion to be disposed at about a 45° angle to said work surface.

11. The bushing handle system of claim 10, wherein said grip portion is attached to said angled portion at an angle effective to cause, when said bottom surface of said head portion is disposed generally coplanar with said work surface, said grip portion to be disposed at about a 15° angle to said work surface.

12. A method of performing a drilling operation comprising:

providing a handle comprising:

a grip portion generally in the configuration of a rectangular prism;

a head portion opposing said grip portion and generally in the configuration of a rectangular prism, said head portion having a top surface and an opposing bottom surface;

a through bore disposed through said head portion from said top surface to said bottom surface, an axis of said through bore being generally perpendicular to a major plane of said head portion, and said through bore sized and shaped to accept a liner bushing; and a liner bushing permanently disposed in said through bore, an axis of said liner bushing being coaxial with said axis of said through bore, and said liner bushing having a lock lip configured to accept a shoulder of a renewable bushing;

providing a plurality of renewable bushings adapted to be coaxially seated in said liner bushing, each of said renewable bushings having a central bore and at least one shoulder;

selecting a first renewable bushing from said plurality of renewable bushings;

seating said first bushing coaxially in said liner bushing;

locking said seated first bushing in said liner bushing at a first shoulder of said at least one shoulders by twisting said seated first bushing to place said first shoulder beneath between said lock lip;

using said grip portion, disposing said seated first bushing in a work surface; and performing a drilling operation through said central bore of said selected first bushing when said seated first bushing is disposed in said work surface.

13. The method of claim 12, wherein said handle further comprises an angled portion disposed between said head portion and said grip portion.

14. The method of claim 13, wherein said angled portion is attached to said head portion at an angle effective to cause, when said bottom surface of said head portion is disposed generally coplanar with a work surface, said angled portion to be disposed at about a 45° angle to said work surface.

15. The method of claim 14, wherein said grip portion is attached to said angled portion at an angle effective to cause, when said bottom surface of said head portion is disposed generally coplanar with said work surface, said grip portion to be disposed at about a 15° angle to said work surface.

16. The method of claim 12, wherein said grip portion comprises a through bore disposed at a distal end thereof.

17. The method of claim 16, wherein said through bore has a diameter smaller than the diameter of said head portion through bore.

18. The method of claim 17, wherein said through bore is sized and shaped to hang said handle.

19. The bushing handle system of claim 8, wherein said lock lip configured to accept a shoulder of a renewable bushing comprises an overhanging element.

20. A bushing handle comprising:

a grip portion generally in the configuration of a rectangular prism;

a head portion opposing said grip portion and generally in the configuration of a rectangular prism, said head portion having a top surface and an opposing bottom surface;

a through bore disposed through said head portion from said top surface to said bottom surface, an axis of said through bore being generally perpendicular to a major plane of said head portion, and said through bore sized and shaped to accept a liner bushing;

a liner bushing permanently disposed in said through bore, an axis of said liner bushing being coaxial with said axis of said through bore, and said liner bushing having a lock lip configured to accept a shoulder of a renewable bushing; and an angled portion disposed between said head portion and said grip portion and attached to said head portion at an angle effective to cause, when said bottom surface of said head portion is disposed generally coplanar with a work surface, said angled portion to be disposed at about a 45° angle to said work surface;

wherein said grip portion is attached to said angled portion at an angle effective to cause, when said bottom surface of said head portion is disposed generally coplanar with said work surface, said grip portion to be disposed at about a 15° angle to said work surface.

* * * * *